US006543096B2

(12) United States Patent
Settelmayer et al.

(10) Patent No.: US 6,543,096 B2
(45) Date of Patent: Apr. 8, 2003

(54) LOAD CARRIER SYSTEM

(75) Inventors: Joseph J. Settelmayer, Fieldbrook, CA (US); Lyle R. Hilk, Eureka, CA (US); Duncan G. Robins, McKinleyville, CA (US); Scott R. Allen, Fieldbrook, CA (US)

(73) Assignee: Yakima Products, Inc., Arcata, CA (US)

( * ) Notice: Subject to any disclaimer, the term of this patent is extended or adjusted under 35 U.S.C. 154(b) by 0 days.

(21) Appl. No.: 09/798,800

(22) Filed: Mar. 2, 2001

(65) Prior Publication Data

US 2001/0054219 A1 Dec. 27, 2001

Related U.S. Application Data

(60) Provisional application No. 60/186,870, filed on Mar. 3, 2000.

(51) Int. Cl.[7] ..... A44B 11/25

(52) U.S. Cl. ..... 24/170; 26/633

(58) Field of Search ..... 24/168, 170, 184, 24/163 FC, 633, 642, 265 BC, 265 EC, 685 K, 695 K, 71 TD, 70 SK, 71 R

(56) References Cited

U.S. PATENT DOCUMENTS

| | | | | | |
|---|---|---|---|---|---|
| 69,628 | A | | 10/1867 | McLain | |
| RE4,781 | E | | 3/1872 | Hatch | |
| 739,963 | A | | 9/1903 | Westlen | |
| 1,483,853 | A | | 2/1924 | Schwerd | |
| 3,608,158 | A | * | 9/1971 | Bengtsson | 24/170 |
| 4,624,033 | A | * | 11/1986 | Orton | 24/633 |
| 4,675,954 | A | | 6/1987 | Gullickson | |
| 4,727,630 | A | | 3/1988 | Alan | |
| 4,901,407 | A | * | 2/1990 | Pandola et al. | 24/633 |
| 4,944,530 | A | * | 7/1990 | Spurrier | 280/801.1 |
| 4,951,364 | A | * | 8/1990 | Marega | 24/68 SK |
| 5,098,162 | A | | 3/1992 | Forget et al. | |
| 5,129,129 | A | | 7/1992 | Collins et al. | |
| 5,161,351 | A | * | 11/1992 | Woodruff | 54/6.1 |
| 5,332,179 | A | | 7/1994 | Kuffel et al. | |
| 5,416,957 | A | * | 5/1995 | Renzi, Sr. et al. | 24/633 |
| 5,442,840 | A | | 8/1995 | Ewald | |
| 5,617,617 | A | | 4/1997 | Gustin | |
| 5,920,963 | A | * | 7/1999 | Chou | 24/170 |
| 6,023,821 | A | | 2/2000 | Murray | |

* cited by examiner

*Primary Examiner*—Robert J. Sandy
(74) *Attorney, Agent, or Firm*—Kolisch Hartwell, P.C.

(57) ABSTRACT

A strap for securing cargo on a vehicle includes a strap and a buckle. The buckle has a releasable strap gripping device, and a cushioning material at least partially surrounding the buckle without obstructing accessibility to the gripping device.

46 Claims, 4 Drawing Sheets

Fig. 1
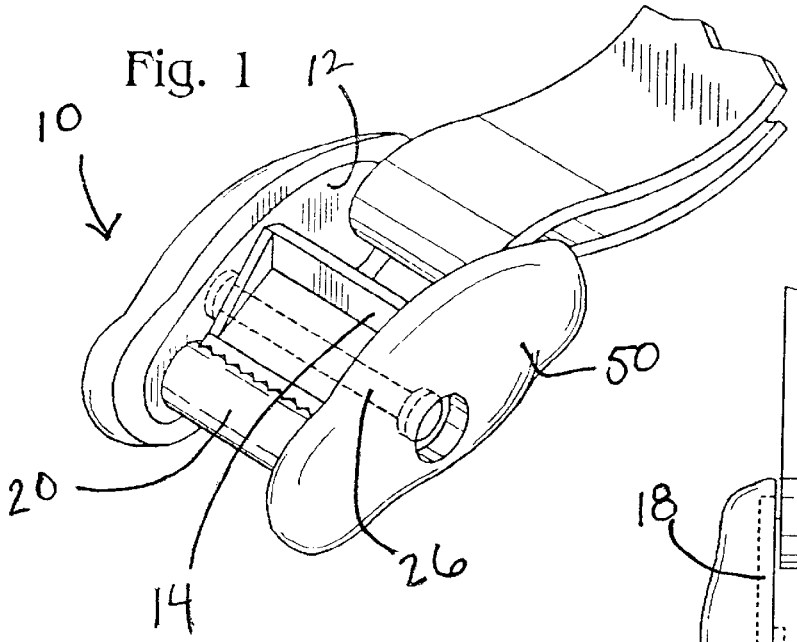
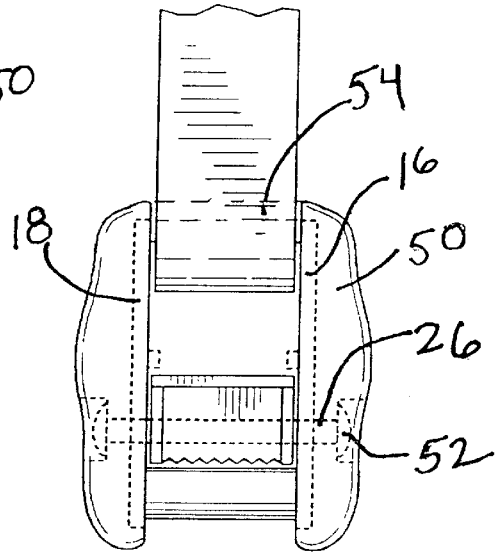
Fig. 4
Fig. 2
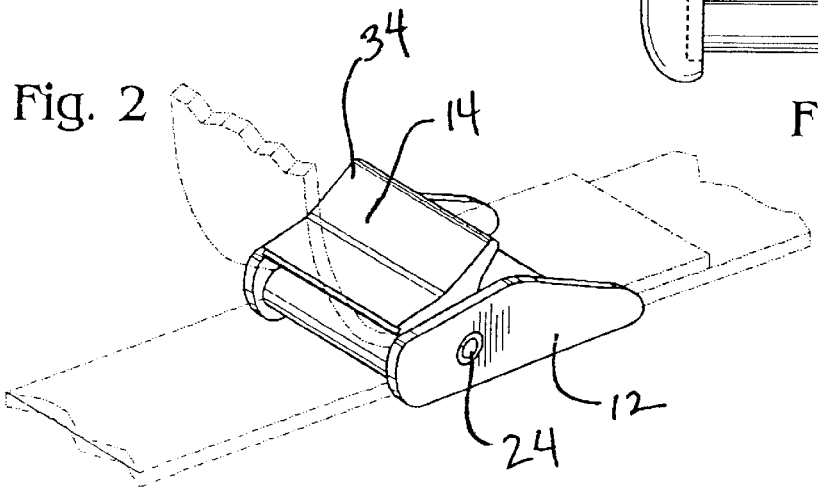
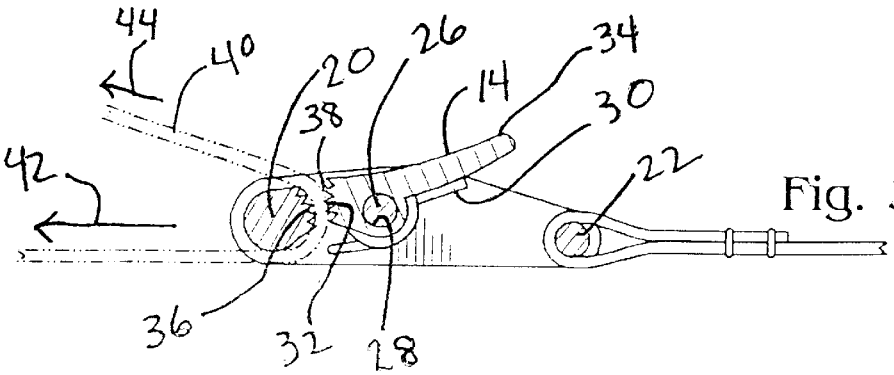
Fig. 3

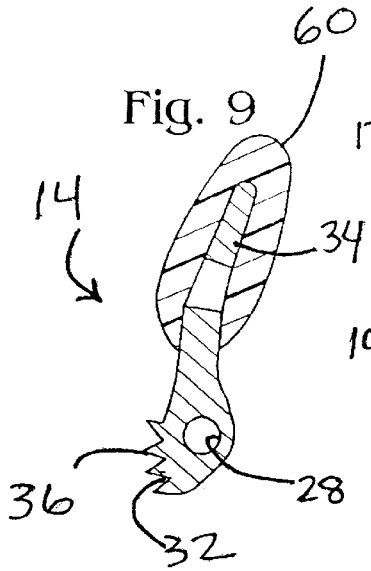
Fig. 9
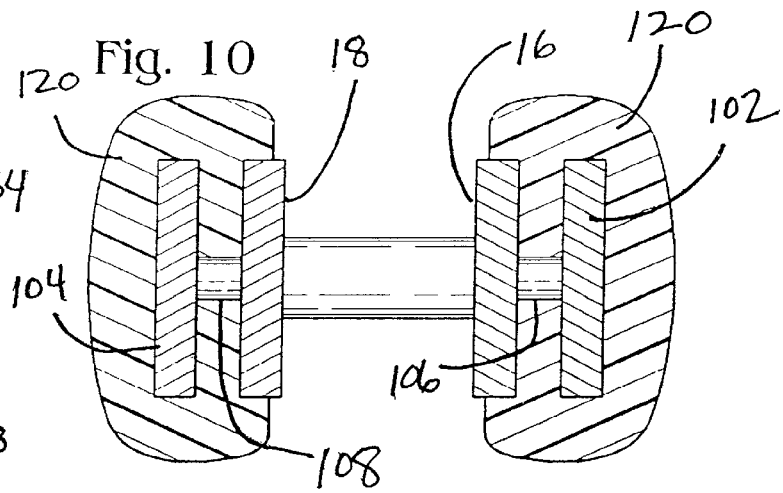
Fig. 10
Fig. 11
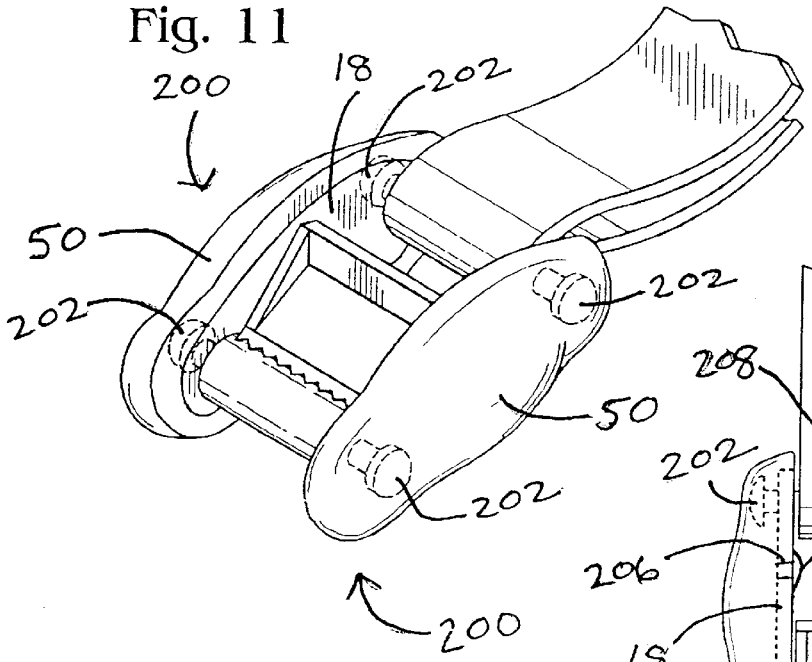
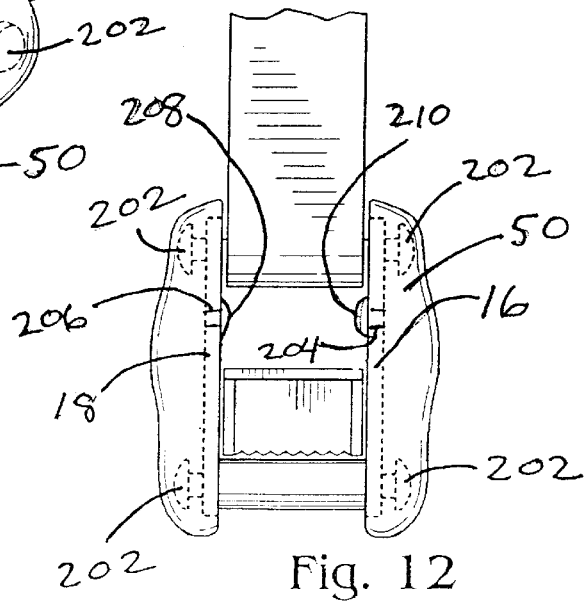
Fig. 12

Fig. 13
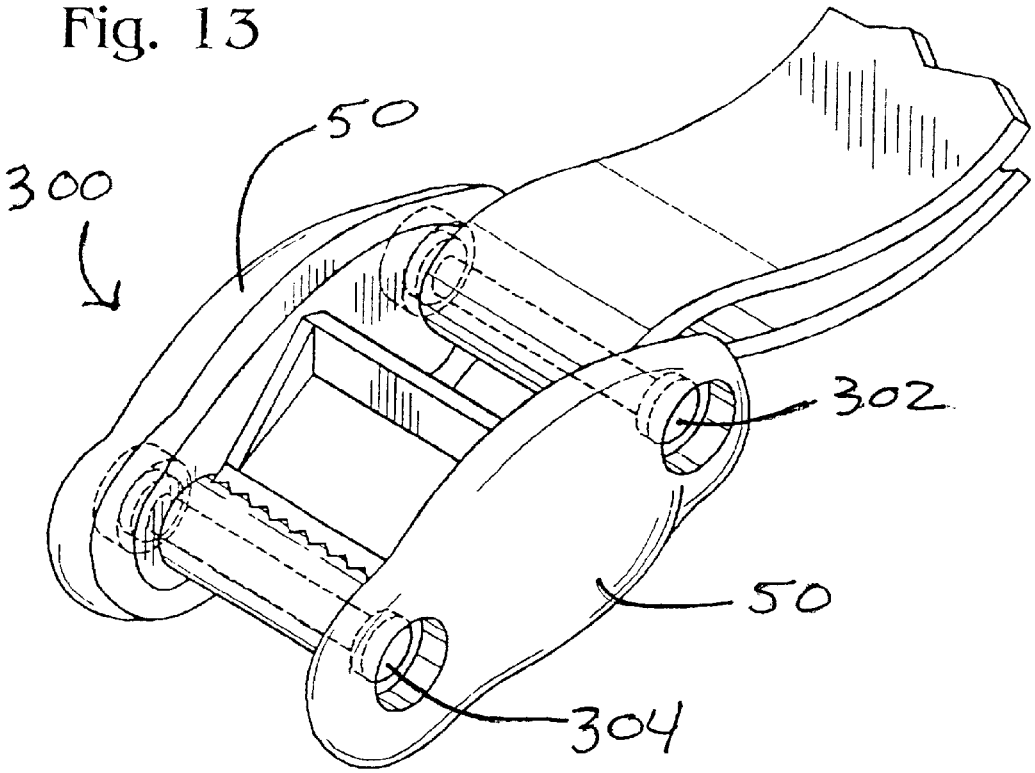
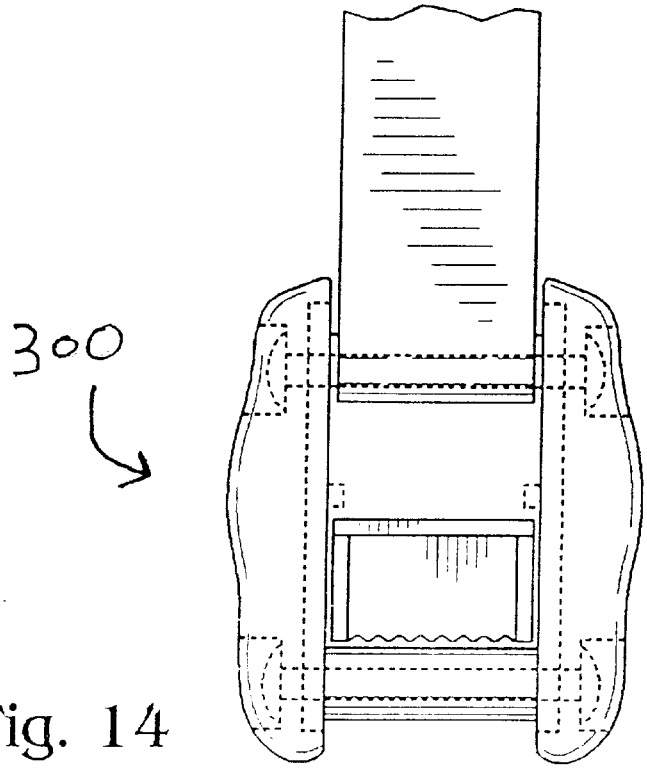
Fig. 14

LOAD CARRIER SYSTEM

CROSS REFERENCE TO RELATED APPLICATION

This application claims priority to U.S. Provisional Patent Application Serial No. 60/186,870 filed Mar. 3, 2000 titled "Load Carrier System," which is hereby incorporated by reference.

FIELD OF THE INVENTION

The present invention relates to buckles and more particularly to buckles used with straps to secure loads to vehicles.

BACKGROUND OF THE INVENTION

Loads are often secured to vehicles by straps that use a buckle to allow the length of the strap to be adjusted. Load carrier straps are often used to secure heavy loads. The buckles must be sturdy and capable of reliably gripping a strap under high tension. Thus, buckles are typically made of metal which creates a risk of damaging the finish of a vehicle on which the strap is used. Metal buckles may also damage the finish on the load being secured by the strap.

U.S. Pat. No. 6,023,821 discloses a buckle cover adapted to slide over a buckle for protecting adjacent objects. Unfortunately, this cover interferes with normal use or adjustment of the buckle. The cover must be slid onto and off of the buckle with each use and is therefore cumbersome to use. The cover is also subject to being dislodged or inadvertently left off, leaving the metal buckle exposed. In addition, the cover is rather bulky and unstylish in appearance.

BRIEF DESCRIPTION OF THE DRAWINGS

FIG. 1 is an isometric view of a buckle constructed according to the present invention.

FIG. 2 is an isometric view of the structural components of a buckle constructed according to the present invention.

FIG. 3 is a cross-sectional view of the structural components of FIG. 2.

FIG. 4 is a bottom view of the buckle of FIG. 1.

FIG. 9 is a c ross-sectional view of the cam of FIG. 7.

FIG. 10 is a cross-sectional view of the buckle of FIG. 5.

FIG. 11 is an isometric view of an alternative buckle according to the present invention.

FIG. 12 is bottom view of the buckle of FIG. 11.

FIG. 13 is an isometric view of an alternative buckle according to the present invention.

FIG. 14 is a bottom view of the buckle of FIG. 13.

DETAILED DESCRIPTION

Figure 5:
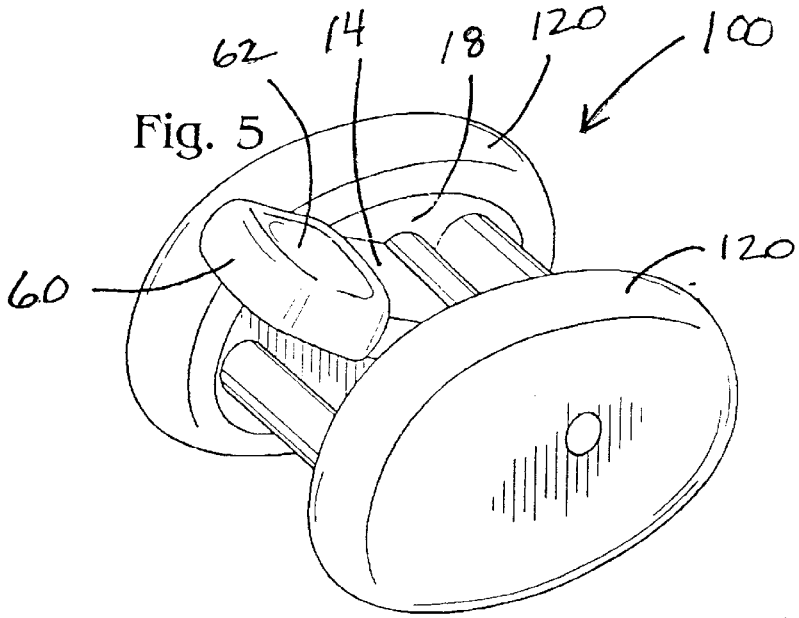
FIG. 5 is an isometric view of an alternative buckle according to the present invention.

The invention provides strap and buckling devices that combine rigid high-strength materials with elastomeric compressible materials in rugged, sturdy designs that are easy to use without damaging the surface of a vehicle or cargo carried on the vehicle.

A buckle constructed according to the present invention is depicted generally at 10 in FIG. 1. Buckle 10 includes a metal frame 12 and a metal cam 14, as shown in FIGS. 2 and 3. Buckle 10 includes side plates 16, 18 and front and rear cross-members 20, 22. Cross-members 20, 22 support side plates 16, 18 in a spaced-apart rigid relationship to each other. Each side member includes at least one bore 24 through which a cam pivot pin 26 fits. The cam pivot pin also passes through a bore 28 in cam 14 to pivotally hold the cam in place relative to the side plates and front cross-member.

A spring 30 biases a front face 32 of cam 14 against front cross-member 26. Cam 14 includes lever portion 34 opposite the front face that a user depresses to move the front face away from cross-member 26. Cross-member 26 includes serrations 36 that cooperate with teeth 38 formed on front face 32 to grip strap 40. When the lever portion is depressed, the strap is free to move between the cam and the frame. When the lever is released, any tension on the strap in a first direction 42 pulls the front face toward the cross-member, thereby firmly pinching the strap and preventing movement. Tension on the strap in the other direction 44 pulls the cam face away from the cross-member, allowing the strap to be tightened, as shown in FIG. 3.

A bumper, protector or cushion 50 is formed on each side plate 16, 18. The cushion is typically affixed to the side by overmolding. The cushion is typically made of a flexible or resilient material, for example TPE, that is soft enough to avoid damaging the surface of a vehicle or cargo being carried by the vehicle. As shown in FIG. 4, pivot pin 26 includes an enlarged portion head 52 at each end. Heads 52 help to mechanically retain the cushions on the frame of the buckle. The cushions may be interconnected by a bridge or web portion 54, which further stabilizes the cushions on the buckle. When utilizing some thermoplastic elastomer materials that do not have direct adhesion to metal parts, it is generally necessary to provide for a mechanical interconnection between the elastomer and the frame.

It should be noted that the cushions extend sufficiently above the side plates of the buckle to shield the cam lever from hitting an adjacent surface such as the surface of a vehicle or load. Although the cushion may not extend around the front or back of the frame, it projects outward sufficiently from the side plates to shield cross-members and other metal parts of the buckle from contact with the vehicle. The cushion is preferably thick and resilient enough to absorb impacts of the buckle on a vehicle without denting or damaging the surface of the vehicle. The cushions are typically formed of a thermoplastic elastomer material, for example, TPE.

Figure 6:
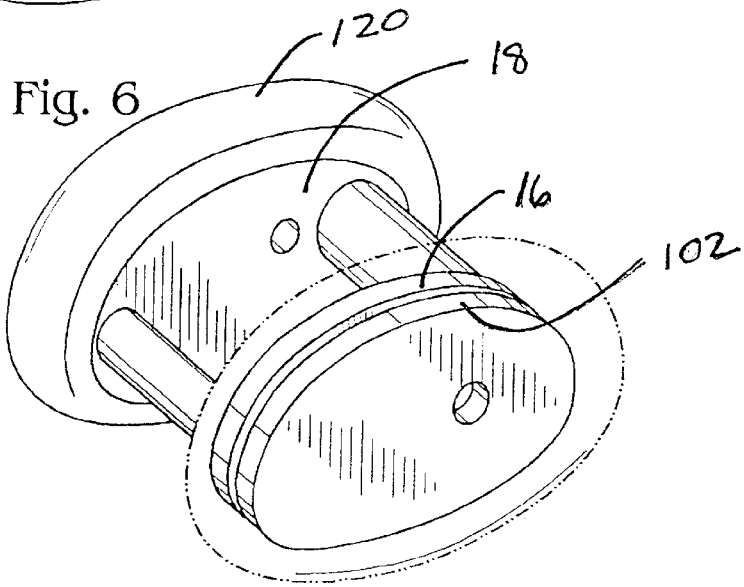
FIG. 6 is an isometric view of a portion of the buckle of FIG. 5.
Figure 7:
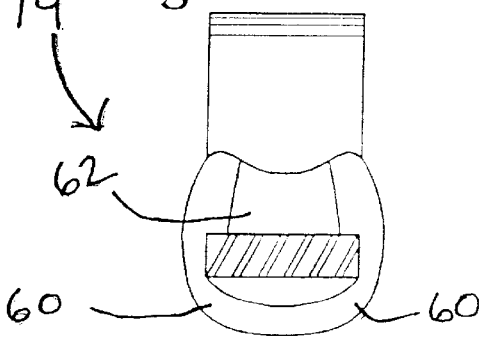
FIG. 7 is a top view of a cam portion of the buckle of FIG. 5.
Figure 8:
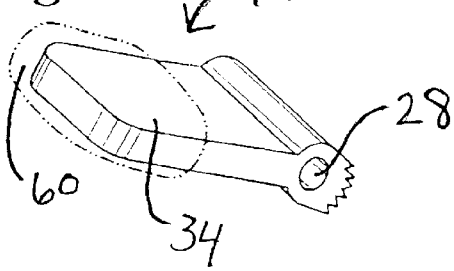
FIG. 8 is an isometric view of the structural portion of the cam of FIG. 7.

FIGS. 5–10 show an alternate buckle 100 according to the present invention. Buckle 100 includes structural components similar to those of buckle 10. However, as shown best in FIGS. 6 and 10, side plates 16, 18 include auxiliary plates 102, 104, respectively. The auxiliary plates are mounted to the side plates on pillars 106, 108, respectively. Preferably, the frame includes both side plates and auxiliary plates molded as a single unit. Cushions 120 are then overmolded onto the frame.

Cam 14 includes a cushion 60 disposed over the lever portion. Cushion 60 includes a depression 62 that provides a comfortable location for a user to place their finger to operate the cam. In instances where the cam lever projects beyond the edges of the side plates and or side plate cushions, the cam cushion serves to provide additional protection against damage to the vehicle finish.

Another buckle constructed according to the present invention is shown in FIG. 11 at 200. Buckle 200 incorporates structural components similar to buckle 10. However, side plates 16, 18 on buckle 200 are formed with mushroom-shaped retainers 202 at the front and rear. The retainers provide a mechanical grip for cushions 50. In addition or alternatively, side plates 16, 18 may include one or more holes 204, 206 that allow a small amount 208, 210 of cushion material to flow through and form a mechanical connection to the side plate.

FIGS. 13 and 14 illustrate another buckle constructed according to the present invention at 300. Buckle 300 incorporates a structural member similar to buckle 10. The main difference is that cushions 50 on buckle 300 are formed separately and attached to the structural member with rivets 302, 304, which pass through the front and rear cross-members. The cushions may also be connected by a piece of elastomer or web portion 54 as with buckle 10.

The various buckles as described herein are useful for attaching loads to vehicles, particularly to roof racks and rear mounted racks. One example of a roof-mounted device that is suitable for use with the disclosed buckles is described in U.S. patent application Ser. No. 09/280,504, which is incorporated herein by reference.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

We claim:

1. A strap fastener comprising a buckle including two rigid lateral supports, a gripping mechanism secured between the supports, and each support having an elastomeric cushion member that at least partially encases the support and prevents the support from contacting a surface adjacent the fastener without obstructing accessibility to the gripping mechanism, and wherein the gripping mechanism includes a pivot pin spanning the supports and a spring-biased cam lever that pivots around the pivot pin between gripping and non-gripping positions.

2. The fastener of claim 1, wherein the lateral supports are connected by at least two cross members.

3. A strap fastener comprising a buckle including two rigid lateral supports, a gripping mechanism secured between the supports, and each support having an elastomeric cushion member that at least partially encases the support and prevents the support from contacting a surface adjacent the fastener without obstructing accessibility to the gripping mechanism, and wherein each lateral support includes a plate member.

4. The fastener of claim 3, wherein the lateral supports are connected by at least one cross member, the cross member having two ends, each end extending through a bore in one of the lateral supports, each end of the cross member having an enlarged head portion securing the cross member and the cushion member to the respective support.

5. The fastener of claim 4, wherein the enlarged head portions are rivets.

6. The fastener of claim 4, wherein each cushion member is molded over an enlarged head portion of one of the cross members.

7. The fastener of claim 4, wherein the cushion members have concavities for receiving the head portions of the cross member.

8. A strap fastener comprising a buckle including two rigid lateral supports, a gripping mechanism secured between the supports, and each support having an elastomeric cushion member that at least partially encases the support and prevents the support from contacting a surface adjacent the fastener without obstructing accessibility to the gripping mechanism, wherein lateral supports are connected by at least two cross members, each cross member having two ends, each end extending through a bore in one of the lateral supports, each end of each cross member having an enlarged head portion securing the cross member in the lateral support so that each lateral support has at least two head portions protruding from an external side of the support, and wherein each cushion member is molded over at least enlarged head portion on the external side of its respective lateral support.

9. The fastener of claim 8, wherein the cushion members have concavities for receiving the head portions of the cross members on the external side of its respective lateral support.

10. The fastener of claim 8, wherein the cushion members have a height that prevents the gripping mechanism from contacting an adjacent surface during normal operation of the gripping mechanism.

11. A strap fastener comprising a buckle including two rigid lateral supports, a gripping mechanism secured between the supports, and each support having an elastomeric cushion member that at least partially encases the support and prevents the support from contacting a surface adjacent the fastener without obstructing accessibility to the gripping mechanism, and wherein the gripping mechanism includes a cam lever that pivots around a pivot pin spanning the lateral supports.

12. The fastener of claim 11, wherein the cam lever has an elastomer-covered end portion.

13. The fastener of claim 11, wherein the cam lever has a front face with teeth for gripping a strap.

14. The fastener of claim 13, wherein the buckle has a front cross member with teeth that cooperate with the teeth on the front face of the cam lever to bite a strap.

15. The fastener of claim 13, wherein the cam lever is spring biased toward engaging the strap.

16. A strap fastener comprising a buckle having a pair of rigid side supports connected by at least one cross member and a pivot pin, and a spring-biased cam lever that pivots around the pivot pin between gripping and non-gripping positions, and each side support having a cushion member over-molded on the side support.

17. The fastener of claim 16, wherein each side support includes a plate.

18. The fastener of claim 16, wherein the cross member has two ends, each end extending through a bore in one of the side supports, each end of the cross member having an enlarged head portion securing the cross member to the side support.

19. The fastener of claim 16, wherein the cushion members are connected by a bridge portion.

20. The fastener of claim 16, wherein the cushion members prevent rigid portions of the buckle from contacting an adjacent surface without obstructing easy manipulative access to the cam lever.

21. The fastener of claim 16, wherein the cam lever has an elastomer-covered end portion.

22. The fastener of claim 16, wherein the cam lever has a front face with teeth for gripping the strap.

23. The fastener of claim 22, wherein the buckle has a front cross member with teeth that cooperate with the teeth on the front face of the cam lever to bite a strap.

24. The fastener of claim 16, wherein each side support has an auxiliary plate member, the respective cushion member being molded over the auxiliary plate member.

25. A strap fastener comprising a buckle having a pair of rigid side supports connected by at least two cross members, each side support having an auxiliary plate structure, and an elastomeric cushion member molded over the plate structure so that the rigid side supports are prevented from contacting an adjacent contact surface.

26. The fastener of claim 25, wherein each side support includes a plate.

27. The fastener of claim 25, wherein the cushion members are connected by a bridge portion.

28. The fastener of claim 25, wherein the buckle includes a gripping mechanism having a pivot pin, and a spring-biased cam lever that pivots around the pivot pin between gripping and non-gripping positions.

29. The fastener of claim 25, wherein each cross member has two ends, each end extending through a bore in one of the side supports, each end of the cross member having an enlarged head portion securing the cross member in the side support so that each side support has at least two head portions protruding from an external side of the support.

30. The fastener of claim 29, wherein the enlarged head portions are rivets.

31. The fastener of claim 29, wherein each cushion member is molded over at least one enlarged head portion on the external side of its respective side support.

32. The fastener of claim 29, wherein the cushion members have concavities for receiving the head portions of the cross members.

33. The fastener of claim 28, wherein the cushion members have a height that prevents the gripping mechanism from contacting an adjacent surface during normal operation of the gripping mechanism.

34. A strap fastener comprising a buckle having a pair of rigid side members, and a strap gripping mechanism between the side plates, each side plate having an over-molded cushion that prevents the side plates and gripping mechanism from contacting an adjacent surface, and wherein the gripping mechanism includes a pivot pin, and a spring-biased cam lever that pivots around the pivot pin between gripping and non-gripping positions.

35. The fastener of claim 34, wherein the cushions are connected by a bridge portion.

36. The fastener of claim 34, wherein the side members are connected by at least two cross members.

37. The fastener of claim 34, wherein the cam lever has an elastomer-covered end portion.

38. The fastener of claim 34, wherein the cam lever has a front face with teeth for gripping a strap.

39. The fastener of claim 38, wherein the buckle has a front cross member with teeth that cooperate with the teeth on the front face of the cam lever to bite a strap.

40. A strap for securing cargo on a surface comprising a strap, a buckle including a releasable strap gripping device, and over-molded lateral bumpers on opposite sides of the gripping device, wherein the gripping device is secured between lateral supports, the lateral supports being connected by a pair of cross members, each cross member having two ends, each end extending through a bore in one of the lateral supports, and each end of the cross member having an enlarged head portion securing the cross member in the lateral support so that each lateral support has at least two head portions protruding from an external side of the support, and wherein the gripping device includes a pivot pin and a spring-biased cam lever that pivots around the pivot pin between gripping and non-gripping positions.

41. The strap of claim 40, wherein the lateral bumpers have a height that prevents the gripping device from contacting an adjacent surface during normal gripping and releasing operation of the gripping device.

42. A strap for securing cargo on a surface comprising a strap, a buckle including a releasable strap gripping device, and over-molded lateral bumpers on opposite sides of the gripping device, and wherein the gripping device is secured between lateral supports, the lateral supports being connected by a pair of cross members, each cross member having two ends, each end extending through a bore in one of the lateral supports, and each end of the cross member having an enlarged head portion securing the cross member in the lateral support so that each lateral support has at least two head portions protruding from an external side of the support.

43. The strap of claim 42, wherein each bumper is molded over at least two enlarged head portions on the external side of its respective lateral support.

44. The strap of claim 42, wherein the bumpers have concavities for receiving the head portions of the cross members.

45. The strap of claim 40, wherein the cam lever has a front face with teeth for gripping a strap.

46. The strap of claim 45, wherein the buckle has a front cross member with teeth that cooperate with the teeth on the front face of the cam lever to bite a strap.

* * * * *